United States Patent [19]

Hirahara

[11] 4,053,344

[45] Oct. 11, 1977

[54] PROCESS OF PRINTING ON NON-PAPER MATERIAL

[76] Inventor: Toyozi Hirahara, 615, Ooaza Osaka, Kashibacho, Katsuragigun, Nara, Japan

[21] Appl. No.: 674,687

[22] Filed: Apr. 7, 1976

[30] Foreign Application Priority Data

Apr. 10, 1975 Japan ..... 50-44422

[51] Int. Cl.[2] ..... B44C 1/14; B44C 3/02

[52] U.S. Cl. ..... 156/247; 101/32; 101/129; 101/426; 156/234; 156/277

[58] Field of Search ..... 101/32, 129, 426; 156/233, 234, 240, 277, 323, 310, 253

[56] References Cited

U.S. PATENT DOCUMENTS

| | | | |
|---|---|---|---|
| 1,892,392 | 12/1932 | Grupe | 101/211 |
| 2,161,223 | 6/1939 | Bener | 101/426 |
| 2,404,073 | 7/1946 | Karfiol et al. | 101/426 |
| 2,477,300 | 7/1949 | Karfiol et al. | 154/47 |
| 2,571,962 | 10/1951 | Smith et al. | 154/47 |
| 2,874,416 | 2/1959 | Burnett | 154/47 |
| 3,289,573 | 12/1966 | Apicella | 101/27 |
| 3,442,742 | 5/1969 | Jorgensen | 156/244 |
| 3,591,402 | 7/1971 | Blackfan | 427/256 |
| 3,669,707 | 6/1972 | Donnelly et al. | 117/161 ZA |
| 3,961,121 | 6/1976 | Warsager | 428/200 |

FOREIGN PATENT DOCUMENTS

| | | | |
|---|---|---|---|
| 118,164 | 2/1946 | Australia | 101/426 |
| 409,957 | 5/1934 | United Kingdom | 101/426 |
| 486,476 | 6/1938 | United Kingdom | 101/426 |
| 1,018,028 | 1/1966 | United Kingdom | 101/426 |
| 15,555 of | 1886 | United Kingdom | 101/426 |

*Primary Examiner*—Clyde I. Coughenour
*Attorney, Agent, or Firm*—Eyre, Mann, Lucas & Just

[57] ABSTRACT

A process of printing letters and/or patterns on an article of non-paper material, such as glass, metal, plastics, porcelain, with the clear and lasting reproduction thereof, by screen printing followed by hot foil transferring to and over the screen printing to give a metallic and attractive appearance.

2 Claims, No Drawings

PROCESS OF PRINTING ON NON-PAPER MATERIAL

BACKGROUND OF THE INVENTION

The invention relates to a process for printing letters and/or patterns on an article of non-paper material, such as plastics, glass, metal. More particularly, the invention relates to a process for the clear and lasting reproduction of letters and/or patterns on an article of non-paper material, which otherwise would be difficult to print on.

It is known in the art that letters and patterns are printed on plastic containers and the like by silk screening or hot stamping. These processes are alternative, and have never before been combined. Silk screening provides a smooth transfer of ink; especially when a rotary screen is employed, the letter or pattern types are kept safe from detrimental deformation, thereby resulting in the sharp and finely-defined reproduction of letters and/or patterns. As compared with the hot stamping printing, silk screening lacks metallic gloss and smooth touch. On the other hand, although hot stamping offers good surfaace lustre and rich appearance, these advantages tend to be offset by the difficulty in printing. In hot stamping, a stamping foil having an adhesive layer on one side is laid over the article with its adhesive side facing the article. The article has a base film upon it. Raised heated printing dies are applied onto the layers, wherein the metal relief heated to 120° C to 130° C is pressed in one stroke at the pressure from about 2 to about 4 kilograms per square centimeter. Under the influence of heat and pressure the synthetic resin content employed tends to melt and become sticky, thereby tending to stick to and fill up the printing dies. In this situation sharp reproduction is impossible. In addition, plastic moulded articles have variations in shape and size, in the range of a given tolerance. This necessitates individual adjustment with printing articles. A further difficulty is derived from the uneven surface of certain types of articles such as bottles, in which the printing tends to be non-uniform due to the unequal contact of the printing dies with the surface of the article.

The present invention aims at solving the problems pointed out, and provides an improved process of printing letters and/or patterns on an article of non-paper material with sharply-defined figures and permanent reproduction thereof.

DETAILED DESCRIPTION OF THE PREFERRED EMBODIMENT

Taking for example a cosmetic bottle which is a plastic moulded article with variations in shape and size, a commercial brand, a decorative pattern, etc. are printed on the surface of the bottle with ink capable of copolymerization, steady vaporization and oxidation polymerization, in the conventional silk screen process. The flexibility of the silk screen allows it to conform to a non-uniform surface whereby a uniform deposit of ink is deposited. The ink is dried until tacky. The proper dryness can be determined by touching the ink with a fingertip. The proper tackiness is achieved when no ink is left on the fingertip. A stamping foil having an adhesive on one side is placed over the printing with the adhesive contacting the tacky ink. The adhesive is of a type which reacts with and adheres to the ink but does not adhere to the article. A heated metal pressure device, heated to a temperature at which the ink can react with the adhesive but below the reaction temperature of the article, is pressed against a silicone rubber layer overlaying the stamping foil with a pressure of from about 2 to about 4 kilograms per square centimeter. The silicone rubber prevents sticking of the foil to the pressure member as is well known in the art. The adhesive layer on the foil is melted under the heat, thereby becoming affixed to the letters and patterns already reproduced on the article by the silk screen process as described above. When the stamping foil still bearing the unaffixed material is removed, the printing which remains on the article is left with a smooth and attractive metallic finish.

This invention is not limited to printing on plastic containers but can also be applied to articles of glass, porcelain and metal. In addition they can be either round or flat.

What is claimed is:

1. A process of printing a pattern on articles of non-paper materials comprising the steps of:

a. printing the pattern in ink on the article by silk screening;

b. drying said ink until tacky;

c. applying a layer of stamping foil having an adhesive layer thereon over the pattern, said adhesive layer contacting said pattern and being reactive with said ink at elevated temperatures;

d. applying a heated pressure member through a rubber layer to said stamping foil;

e. the temperature of said heated pressure member being above the temperature at which the ink reacts adhesively with the foil and below the reaction temperature of the article whereby the foil which contacts the ink becomes adhered thereto; and f. removing the unadhered stamping foil.

2. A process of printing patterns on an article of non-paper material as claimed in claim 1, wherein the ink employed is capable of copolymerization, quick vaporization and oxidation polymerization.

* * * * *